US007896458B2

(12) United States Patent
Ito

(10) Patent No.: US 7,896,458 B2
(45) Date of Patent: Mar. 1, 2011

(54) IMAGE RECORDING APPARATUS THAT CONTROLS MEDIUM FEED TIMING ACCORDING TO DRIVE DATA SUPPLY TO PRINTHEADS

(75) Inventor: Koji Ito, Gifu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 133 days.

(21) Appl. No.: 12/189,758

(22) Filed: Aug. 11, 2008

(65) Prior Publication Data

US 2009/0040285 A1 Feb. 12, 2009

(30) Foreign Application Priority Data

Aug. 10, 2007 (JP) ..... 2007-210079

(51) Int. Cl.
*B41J 29/38* (2006.01)

(52) U.S. Cl. ..... 347/16; 347/13

(58) Field of Classification Search ..... 347/16, 347/13

See application file for complete search history.

(56) References Cited

U.S. PATENT DOCUMENTS

| | | | | |
|---|---|---|---|---|
| 5,043,748 | A * | 8/1991 | Katayama et al. | 347/16 |
| 6,164,756 | A * | 12/2000 | Takahashi et al. | 347/43 |
| 6,568,776 | B1 * | 5/2003 | Kato | 347/8 |
| 2004/0113977 | A1 * | 6/2004 | Esaki et al. | 347/42 |
| 2006/0268027 | A1 * | 11/2006 | Lim | 347/9 |

FOREIGN PATENT DOCUMENTS

JP 2001-277645 A 10/2001

* cited by examiner

*Primary Examiner* — Matthew Luu
*Assistant Examiner* — Shelby Fidler
(74) *Attorney, Agent, or Firm* — Baker Botts L.L.P.

(57) ABSTRACT

An image recording apparatus includes a sheet feeder, line-type printheads arranged in a sheet feed direction, a drive-data supplier and a feed controller. The feed controller has the sheet feeder initiate feeding a following sheet which is fed next to a preceding sheet, (i) at a first feed timing in order that a distance between the preceding sheet and the following sheet becomes smaller than a dimension of a recording area of the printheads in the sheet feed direction, when the drive-data supplier can supply the drive data to the printheads at a concurrent-recording enabling timing at which it is possible to concurrently record, at the recording area, an image on a trailing end portion of the preceding sheet and an image on a trailing end portion of the preceding sheet and an image on a front end portion of the following sheet, and (ii) at a second feed timing having a longer interval than that of the first feed timing, when the drive-data supplier can not supply the drive data at the concurrent-recording enabling timing.

12 Claims, 13 Drawing Sheets

FIG.5

| | |
|---|---|
| FEED MODE A | MONOCHROME-RECORDING MODE |
| FEED MODE B | COLOR-RECORDING MODE |

FIG.6

| | | | |
|---|---|---|---|
| FEED MODE A | LOW-SPEED FEED MODE | MANUALLY FED RECORDING SHEET | HIGH RESOLUTION |
| FEED MODE B | HIGH-SPEED FEED MODE | REGULAR RECORDING SHEET | NORMAL RESOLUTION |

FIG.7

| | |
|---|---|
| FEED MODE A | COPIER MODE |
| FEED MODE B | PRINTER MODE |

FIG.13

| | |
|---|---|
| FEED MODE A | SMALL AMOUNT OF DATA |
| FEED MODE B | LARGE AMOUNT OF DATA |

FIG.14

| | |
|---|---|
| FEED MODE A | IDENTICAL IMAGES |
| FEED MODE B | DIFFERENT IMAGES |

IMAGE RECORDING APPARATUS THAT CONTROLS MEDIUM FEED TIMING ACCORDING TO DRIVE DATA SUPPLY TO PRINTHEADS

CROSS REFERENCE TO RELATED APPLICATION

The present application claims priority from Japanese Patent Application No. 2007-210079, which was filed on Aug. 10, 2007, the disclosure of which is herein incorporated by reference in its entirety.

BACKGROUND OF THE INVENTION

1. Field of the Invention

The present invention relates to an image recording apparatus including a plurality of line-type printheads.

2. Discussion of Related Art

In an image recording apparatus which records an image on each of a plurality of recording media such as cut sheets, in order to enhance throughput, for example, it can be generally considered that a distance in a medium feed direction between two recording media (a preceding recording medium and a following recording medium) which are sequentially fed one by one in the medium feed direction is made as small as possible. For example, Patent Document 1 (JP-A-2001-277645) discloses an image recording apparatus including a serial-type printhead which moves in a main scanning direction of a plurality of recording media and records an image on each of the recording media, the printhead concurrently recording respective images on each of the two recording media while being opposed to the two recording media. According to Patent Document 1, the recording media are fed such that the following recording medium is fed to a recording area to be opposed to the printhead before the preceding recording medium passes through the recording area. Accordingly, the printhead concurrently records respective images on a trailing end portion of the preceding recording medium and a front end portion of the following recording medium.

In a case where the prior art disclosed in Patent Document 1 is applied to an image recording apparatus including a plurality of line-type printheads which do not move in the main scanning direction of the recording media and record an image on each of the recording media, the recording media are fed by a feeding device such that the following recording medium is fed to a recording area before the preceding recording medium passes through the recording area, and the line-type printheads concurrently records respective images on the trailing end portion of the preceding recording medium and the front end portion of the following recording medium at the recording area. The recording area corresponds to an area between a most upstream one and a most downstream one of the printheads in the medium feed direction of the recording media by the feeding device.

As mentioned above, when the recording media are fed by the feeding device such that the following recording medium is fed to the recording area before the preceding recording medium passes through the recording area, a plurality of pieces of drive data for the following recording medium should be supplied to the printheads before the preceding recording medium passes through the recording area. On the other hand, times necessary for supplying the pieces of drive data for one recording medium to the line-type printheads differ from each other depending on recording conditions. For example, data amounts of the drive data are different from each other in a case where an image of monochrome is recorded on the recording medium and a case where an image of color is recorded thereon. In a case where the remaining recording conditions are identical with each other in a mode of monochrome-recording and a mode of color-recording, the time necessary for supplying the pieces of drive data for one recording medium to the line-type printheads in the case of color-recording is longer than that in the case of monochrome-recording. Therefore, when the image of color is recorded on the recording medium under the same recording condition as that of the case of monochrome-recording, it is highly possible that the drive data for the following recording medium cannot be supplied to the printheads before the following recording medium, which is fed next to the preceding recording, is fed to the recording area.

In order to prevent the above-mentioned problem, in an image recording apparatus disclosed in Patent Document 1, when an image is to be recorded across two consecutively fed recording media, and at a timing of initiation of the image recording, a portion of data of the image corresponding to the following recording medium is still being received or the portion of the data has been received but is being converted or decoded into raster type data, the image recording apparatus initiates the concurrent image recording across the two recording media only after the converting of the portion of the data is complete. In the image recording apparatus having the line-type printheads, however, a speed of feeding the recording media within the recording area is necessary to be changed, so that it is generally difficult to apply the above-mentioned manner to the image recording apparatus having the line-type printheads.

In order that the images are concurrently recorded on the preceding recording medium and the following recording medium at the recording area in either one of the color-recording mode and the monochrome-recording mode, the recording conditions should be determined such that the drive data for the following recording medium can be supplied in time to the printheads in either one of the color-recording mode and the monochrome recording mode. Under this circumstance, the recording conditions applicable to the image recording apparatus are restricted.

SUMMARY OF THE INVENTION

It is therefore an object of the present invention to provide an image recording apparatus that can maintain a performance of throughput without restricting recording conditions.

The above-mentioned object may be achieved according to any one of the following modes of the present invention in the form of the image recording apparatus, each of which is numbered like the appended claims and may depend from the other mode or modes, where appropriate, to indicate and clarify possible combinations of technical features. It is, however, to be understood that the present invention is not limited to the technical features or any combinations thereof that will be described below for illustrative purposes only. It is to be further understood that a plurality of features included in any one of the following modes of the invention are not necessarily provided altogether, i.e., the invention may be embodied without employing at least one of the features described in connection with each of the modes. It is to be further understood that an additional feature or features may be added to any one of the following modes.

(1) An image recording apparatus comprising:

a plurality of line-type printheads which are disposed parallel to one another and arranged in a medium feed direction, the printheads recording an image on each of a plurality of recording media which are sequentially fed one by one in the medium feed direction;

a feeding device which sequentially feeds the recording media to a recording area, two opposite ends of which in the medium feed direction respectively correspond to a most upstream one and a most downstream one of the printheads;

a drive-data supplying portion which generates a plurality of pieces of drive data for driving the printheads on the basis of image data of the image to be recorded on the recording medium, and supplies the pieces of drive data to the respectively corresponding printheads; and a feed control portion which has the feeding device initiate feeding of one of the recording media as a following recording medium which is fed next to another recording medium as a preceding recording medium, (i) at a first feed timing in order that a distance between a trailing end of the preceding recording medium and a front end of the following recording medium becomes smaller than a dimension of the recording area in the medium feed direction, when the drive-data supplying portion can supply the drive data to the printheads at a concurrent-recording enabling timing at which it is possible to concurrently record, at the recording area, an image on a trailing end portion of the preceding recording medium and an image on a front end portion of the following recording medium, and (ii) at a second feed timing in order that the distance between the trailing end of the preceding recording medium and the front end of the following recording medium becomes equal to or larger than the dimension of the recording area in the medium feed direction, when the drive-data supplying portion cannot supply the drive data to the printheads at the concurrent-recording enabling timing.

When each of the plurality of the line-type printheads includes a plurality of recording elements apart from one another with respect to the medium feed direction, the recording area corresponds to a distance in the medium feed direction between a most upstream one of the recording elements of the most upstream printhead in the medium feed direction and a most downstream one of the recording elements of the most downstream printhead.

According to the present mode, the feed control portion has the feeding device initiate feeding of the following recording medium at either one of the first feed timing, at which the following recording medium is fed to the recording area before the preceding recording medium passes through the recording area, or the second feed timing, at which the following recording medium is fed to the recording area after the preceding recording medium passes through the recording area. When the drive-data supplying portion cannot supply the drive data to the printheads at the concurrent-recording enabling timing, the second feed timing is selected, at which the drive-data supplying portion is not forced to supply the drive data at the concurrent-recording enabling timing. Therefore, the image recording apparatus is provided such that a wide range (variety) of recording conditions can be selected, without restricting the recording conditions in order to correspond to the first feed timing. When the recording media are fed at the first feed timing, or when the drive-data supplying portion can supply the drive data to the printheads at the concurrent-recording enabling timing, throughput can be enhanced.

(2) The image recording apparatus according to the mode (1), further comprising a timing selecting portion selecting one of the first feed timing and the second feed timing which are respectively predetermined, depending on whether the drive-data supplying portion can supply the drive data at the concurrent-recording enabling timing or not, and wherein the feed control portion has the feeding device initiate the feeding of each of the recording media at the one of the first feed timing and the second feed timing that is selected by the timing selecting portion.

According to the present mode in which the image recording apparatus includes the timing selecting portion selecting one of the first feed timing and the second feed timing, the feeding device and the feed control portion can be simply composed.

(3) The image recording apparatus according to the mode (1) or the mode (2), which selectively operates in one of a first mode and a second mode which differ from each other in at least one of (a) a time necessary for the drive-data supplying portion to supply the printheads with the drive data for each of the recording media, and (b) a time necessary for each of the recording media to pass through the recording area, and wherein when the image recording apparatus operates in the first mode, the feed control portion has the feeding device initiate the feeding of the following recording medium at the first feed timing, and when the image recording apparatus operates in the second mode, the feed control portion has the feeding device initiate the feeding of the following recording medium at the second feed timing. According to the present mode, one of the first and the second modes (two recording modes) that differ from each other in recording conditions can be selected, and appropriate one of two feed modes can be selected depending on the recording conditions.

(4) The image recording apparatus according to the mode (3), which operates in the first mode when the image data inputted to the drive-data supplying portion is of monochrome, and operates in the second mode when the image data inputted to the drive-data supplying portion is of color.

According to the present mode, one of the two timings for feeding can be properly selected depending on whether the image data inputted to the drive-data supplying portion is of monochrome or of color.

(5) The image recording apparatus according to the mode (3) or the mode (4), wherein the first mode and the second mode differ from each other in a speed at which the feeding device feeds each of the recording media.

(6) The image recording apparatus according to any of the modes (3) through (5), which selectively operates in one of the first mode and the second mode depending on the kind of the recording media.

According to the present mode, for example, when one of the first mode and the second mode different from each other in the feed speed is selected depending on the kind of the recording media, an appropriate feed timing can be selected.

(7) The image recording apparatus according to any of the modes (3) through (6), which selectively operates in one of the first mode and the second mode depending on a resolution in the medium feed direction of the images to be recorded on the recording media.

According to the present mode, when a resolution in the medium feed direction of the images to be recorded on the recording media is changed by changing the feed speed of each of the recording media by the feeding device, an appropriate feed timing can be selected.

(8) The image recording apparatus according to any of the modes (1) through (7), wherein when images to be recorded respectively on the preceding recording medium and the following recording medium differ from each other, the feed control portion has the feeding device initiate the feeding of the following recording medium at the second feed timing, and when the images to be recorded respectively on the preceding recording medium and the following recording medium are identical with each other and the drive-data supplying portion can supply the printheads with the drive data for the following recording medium before the preceding recording medium passes through the recording area, the feed control portion has the feeding device initiate the feeding of the following recording medium at the first feed timing.

When the images to be recorded respectively on the preceding recording medium and the following recording medium are identical with each other, the drive-data supplying portion can supply the printheads with the drive data for the following recording medium which is identical with the drive data for the preceding recording medium, so that the feed control portion can have the feeding device initiate the feeding of the following recording medium at the first feed timing. Accordingly, an appropriate one of the first feed timing or the second feed timing can be selected depending on whether the image to be recorded on the following recording medium is identical with or different from the image to be recorded on the preceding recording medium.

(9) The image recording apparatus according to any of the modes (1) through (8), wherein every time one of the recording media as the following recording medium is about to be fed, it is determined whether a data amount of the image data of the image to be recorded on the following recording medium is larger than a threshold, and when the data amount is larger than the threshold, the feed control portion has the feeding device initiate the feeding of the following recording medium at the second feed timing, and when the data amount is not larger than the threshold and the drive-data supplying portion can supply the printheads with the drive data for the following recording medium before the preceding recording medium passes through the recording area, the feed control portion has the feeding device initiate the feeding of the following recording medium at the first feed timing.

According to the present mode, when times necessary for supplying the drive data with the printheads differ from one another among the recording media depending on the data amount of the image data, an appropriate one of the first and the second feed timings can be selected depending on the data amount of the image data.

(10) The image recording apparatus according to any of the modes (1) through (9), further comprising:

a reading device which reads an image formed on a document; and a read-image supplying portion which generates read-image data which is image data of the image read by the reading device, and supplies the read-image data to the drive-data supplying portion, and wherein when the read-image supplying portion supplies the read-image data to the drive-data supplying portion and the drive-data supplying portion can supply the printheads with the drive data for the following recording medium before the preceding recording medium passes through the recording area, the feed control portion has the feeding device initiate the feeding of each of the recording media at the first feed timing.

When the image read by the reading device is recorded on the recording medium, it often occurs that the identical images are sequentially recorded on the respective recording media. When the identical images are sequentially recorded on the recording media, the drive-data supplying portion can supply the printheads with the drive data which are identical with each other, so that the feed control portion can have the feeding device initiate the feeding of each of the recording media at the first feed timing.

(11) The image recording apparatus according to any of the modes (1) through (10), wherein each of the printheads include a plurality of recording elements apart from one another with respect to the medium feed direction, and the first feed timing is such that the distance between the trailing end of the preceding recording medium and the front end of the following recording medium becomes larger than a distance in the medium feed direction between two of the recording elements which are the most distant from each other in the medium feed direction in each of the printheads.

(12) The image recording apparatus according to any of the modes (1) through (10), wherein the printheads include a plurality of groups of printheads each of which corresponds to one of a plurality of colors, and the first feed timing is such that the distance between the trailing end of the preceding recording medium and the front end of the following recording medium becomes larger than a dimension of each of the groups in the medium feed direction.

When each of the plurality of line-type printheads includes a plurality of recording elements apart from one another with respect to the medium feed direction, the first feed timing is such that a distance in the medium feed direction between a most upstream one of the plurality of recording elements of a most upstream one of the groups of printheads each of which corresponds to one of the plurality of colors, and a most downstream one of the plurality of recording elements of a most downstream one of the groups of printheads.

In a case where each of the recording media is fed without a distance therebetween, it can be difficult to control the printheads. According to the image recording apparatus mentioned above, even when the first feed timing is selected, the first feed timing is such that the distance between the trailing end of the preceding recording medium and the front end of the following recording medium becomes larger than a dimension of each of the groups of printheads each of which corresponds to one of a plurality of colors in the medium feed direction, so that the printheads can be easily controlled.

(13) The image recording apparatus according to any of the modes (1) through (12), wherein the printhead has a recording surface on which are formed a plurality of recording elements from each of which a liquid is ejected in the form of droplet in order to form the image on the recording medium, and wherein when the feed control portion has the feeding device initiate the feeding of the following recording medium at the first feed timing, the drive data supplied from the drive-data supplying portion to at least one of the printheads, which is not to be opposed to either of the preceding and following recording media while the concurrent image recording on the trailing end portion of the preceding recording medium and the front end portion of the following recording medium is performed, is adjusted in order not to eject the liquid from the recording elements of the at least one printhead.

According to the present mode, even when the first feed timing is selected, the drive data are adjusted in order not to eject the liquid from the recording elements of the at least one printhead, and a meniscus oscillating operation can be performed at an interval between image recording operations.

(14) The image recording apparatus according to any of the modes (1) through (13), wherein where $t1$ represents a time necessary for the preceding recording medium to pass through the recording area and $t2$ represents a time necessary for the drive-data supplying portion to supply the printheads with the drive data for the following recording medium, and where a speed at which the feeding device feeds each of the recording media changes from a value establishing a first condition: $t1 \geqq t2$ to a value establishing a second condition: $t1 < t2$, the feed control portion has the feeding device initiate the feeding of each of the recording medium at the first feed timing while the first condition is established, and at the second feed timing while the second condition is established.

For example, after the feed control portion has the feeding device initiate feeding each of the recording media, there is needed a time for accelerating a speed at which the feeding device feeds each of the recording media to a predetermined speed. In this case, even where the second feed timing should be selected after the speed of feeding (feed speed) reached the predetermined speed, during an acceleration of the feed speed, the first feed timing can be selected. When the first feed timing is selected during an appropriate period such as the acceleration period, a performance of throughput can be enhanced.

BRIEF DESCRIPTION OF THE DRAWINGS

The above and optional objects, features, and advantages of the present invention will be better understood by reading the following detailed description of the preferred embodiments of the invention when considered in conjunction with the accompanying drawings, in which:

FIG. 5 is an illustrative view showing conditions on which one of a feed mode A and a feed mode B is selected depending on selecting of a color-recording mode or a monochrome-recording mode;

FIG. 6 is an illustrative view showing conditions on which one of the feed mode A and the feed mode B is selected depending on difference in feed speed, kind of the recording sheets, and resolution;

FIG. 7 is an illustrative view showing conditions on which one of the feed mode A and the feed mode B is selected depending on selecting of a copier mode or a printer mode;

FIG. 13 is a view illustrating one example of a content of step S21 of the flow chart shown in FIG. 12; and FIG. 14 is a view illustrating another example of a content of step S21 of the flow chart shown in FIG. 12.

DETAILED DESCRIPTION OF THE PREFERRED EMBODIMENTS

Figure 1:
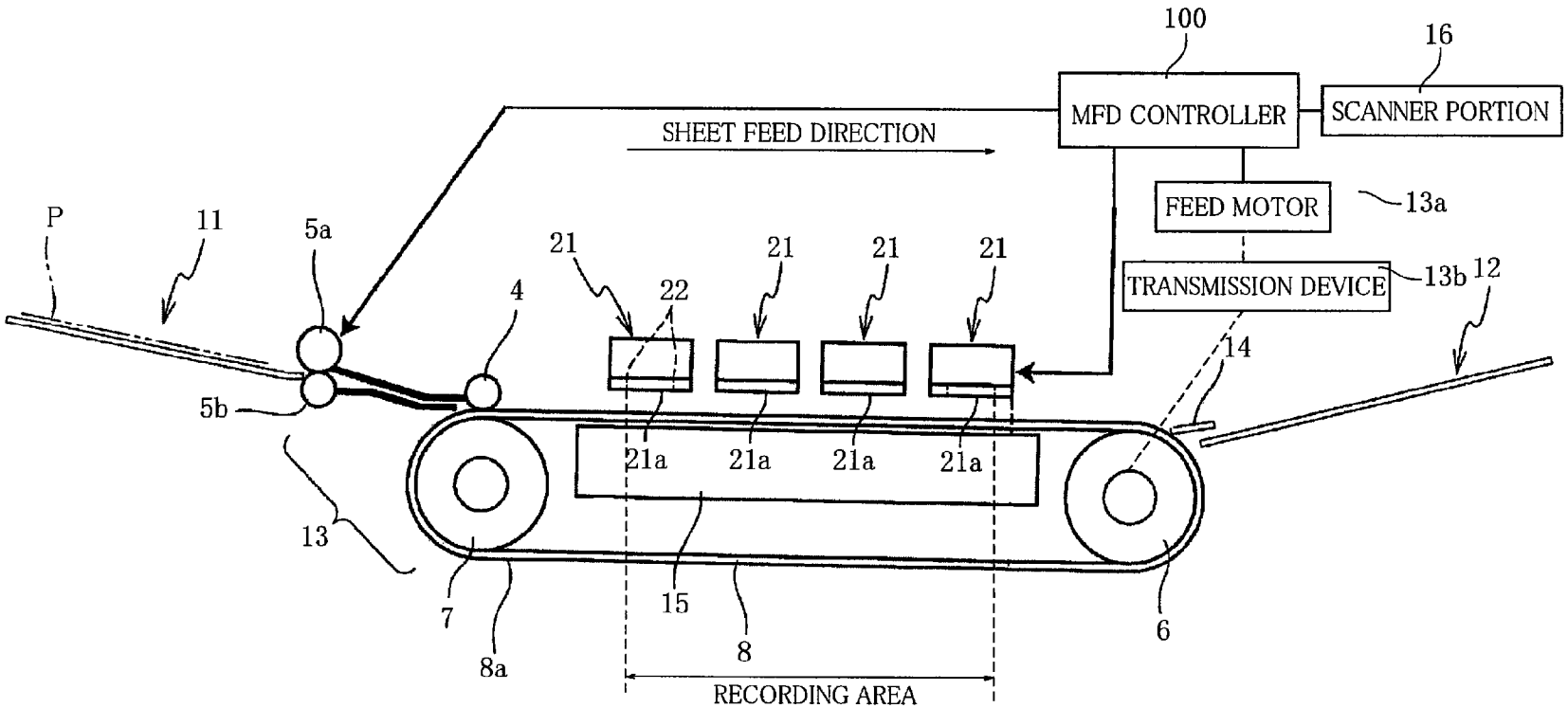
FIG. 1 is a side view showing an appearance of an inkjet multi-function device (MFD) as one embodiment (a first embodiment) to which the present invention is applied.

Hereinafter, there will be described preferred embodiments of the present invention with reference to the drawings. FIG. 1 shows an appearance of an inkjet multi-function device (MFD) 1 as one embodiment of the present invention. As shown in FIG. 1, the MFD 1 is a color inkjet multi-function device which includes four printheads (inkjet recording heads) 21. The MFD 1 has a scanner portion 16 as a reading device which reads an image formed on a sheet plane of a document (an original sheet). In the MFD 1, there are provided a sheet-feed portion 11 on a left-hand side of FIG. 1 and a sheet-discharge portion 12 on a right-hand side of FIG. 1. The sheet-feed portion 11 includes a sheet case which accommodates a plurality of recording sheets (cut sheets) P as recording media with a regular size, and a manual sheet-feed tray for feeding the recording sheets P with various sizes and (or) kinds, and each of the recording sheets P is fed from one of the sheet case and the manual sheet-feed tray.

In the MFD 1, there is formed a sheet-feed path for feeding the recording sheet P from the sheet-feed portion 11 to the sheet-discharge portion 12. A feeding device 13 which feeds the recording sheet P along the sheet-feed path is provided as follows. The feeding device 13 includes a pair of feed rollers 5*a*, 5*b* disposed on a downstream side of the sheet-feed portion 11 in a sheet feed direction as a medium feed direction. The feed rollers 5*a*, 5*b* cooperate with each other to nip the recording sheet P and to feed the recording sheet P from the sheet-feed portion 11 to a right-hand direction in FIG. 1 or to the sheet-discharge portion 12 in the sheet feed direction.

In a middle portion of the sheet-feed path, the feeding device 13 includes a pair of belt rollers 6, 7, an endless feed belt 8 which is wound on the belt rollers 6, 7, and a platen 15 which is opposed to the printheads 21 within an area defined by the feed belt 8. The platen 15 supports the feed belt 8 within an area of the MFD 1 which is opposed to the printheads 21, preventing the feed belt 8 from being bent downward. The feeding device 13 further includes a nip roller 4 which is located opposite to the belt roller 7. The nip roller 4 presses the recording sheet P, which is fed from the sheet-feed portion 11 by the feed rollers 5*a*, 5*b*, against an outer circumferential surface 8*a* of the feed belt 8.

The feeding device 13 further includes a feed motor 13*a* and a transmission device 13*b* which transmits a rotation of the feed motor 13*a* to a belt roller 6. The feed motor 13*a* and the transmission device 13*b* cooperate with each other to rotate the belt roller 6 so as to drive the feed belt 8. Accordingly, the recording sheet P is fed to the sheet-discharge portion 12, pressed against the outer circumferential surface 8*a* of the feed belt 8 and supported by the feed belt 8. In the present embodiment, a direction extending from the sheet-feed portion 11 to the sheet-discharge portion 12, or a direction from a left-hand side to a right-hand side in FIG. 1 is the sheet feed direction by the feeding device 13.

On a downstream side of the feed belt 8 along the sheet-feed path, there is provided a sheet-separate device 14. The sheet-separate device 14 is for separating the recording sheet P which is supported by and stuck to the outer circumferential surface 8*a* of the feed belt 8 from the same 8*a*, and for feeding the separated recording sheet P rightward in FIG. 1 or toward the sheet-discharge portion 12 in the sheet feed direction.

The four printheads 21 are line-type printheads which are disposed parallel to one another and arranged in the sheet feed direction of the recording sheet P, corresponding to four colors of inks (magenta, yellow, cyan, and black). Each of the four printheads 21 has a generally rectangular parallelepiped shape extending in a direction perpendicular to the sheet feed direction. Each of the printheads 21 has a plurality of nozzles 22 as recording elements which are formed on (opens to) a lower surface or an ejection surface (a recording surface) 21*a* thereof so as to eject a corresponding one of the four colors of inks. The nozzles 22 are arranged in sixteen rows apart from one another with respect to the sheet feed direction. The sixteen nozzle rows adjacent to each other are sifted by a small amount in the direction perpendicular to the sheet feed direction, or the sixteen nozzle rows are arranged in a zigzag or a staggered manner. The plurality of nozzles 22 may be arranged in one row or in two rows or more. When the recording sheet P is fed by the feed belt 8 and passes right below the ejection surface 21*a* of each of the printheads 21, droplets of the ink of each color are ejected from each of the nozzles 22 toward an upper surface of the recording sheet P. A desired image of color or of monochrome is thus recorded on the recording sheet P. Each of the printheads 21 is not movable relative to the platen 15 during an image recording operation. Therefore, an area between a most upstream one and a most downstream one of the four printheads 21 in the sheet feed direction, more precisely, an area between a most upstream one (row) of the nozzles 22 of the most upstream one of the printheads 21 in the sheet feed direction and a most downstream one (row) of the nozzles 22 of the most downstream one of the printheads 21 in the sheet feed direction, is an area in which the inks are ejected toward the recording sheet P during the image recording operation. Hereinafter, the above-mentioned area will be referred to as a recording area (a printing area).

Figure 2:
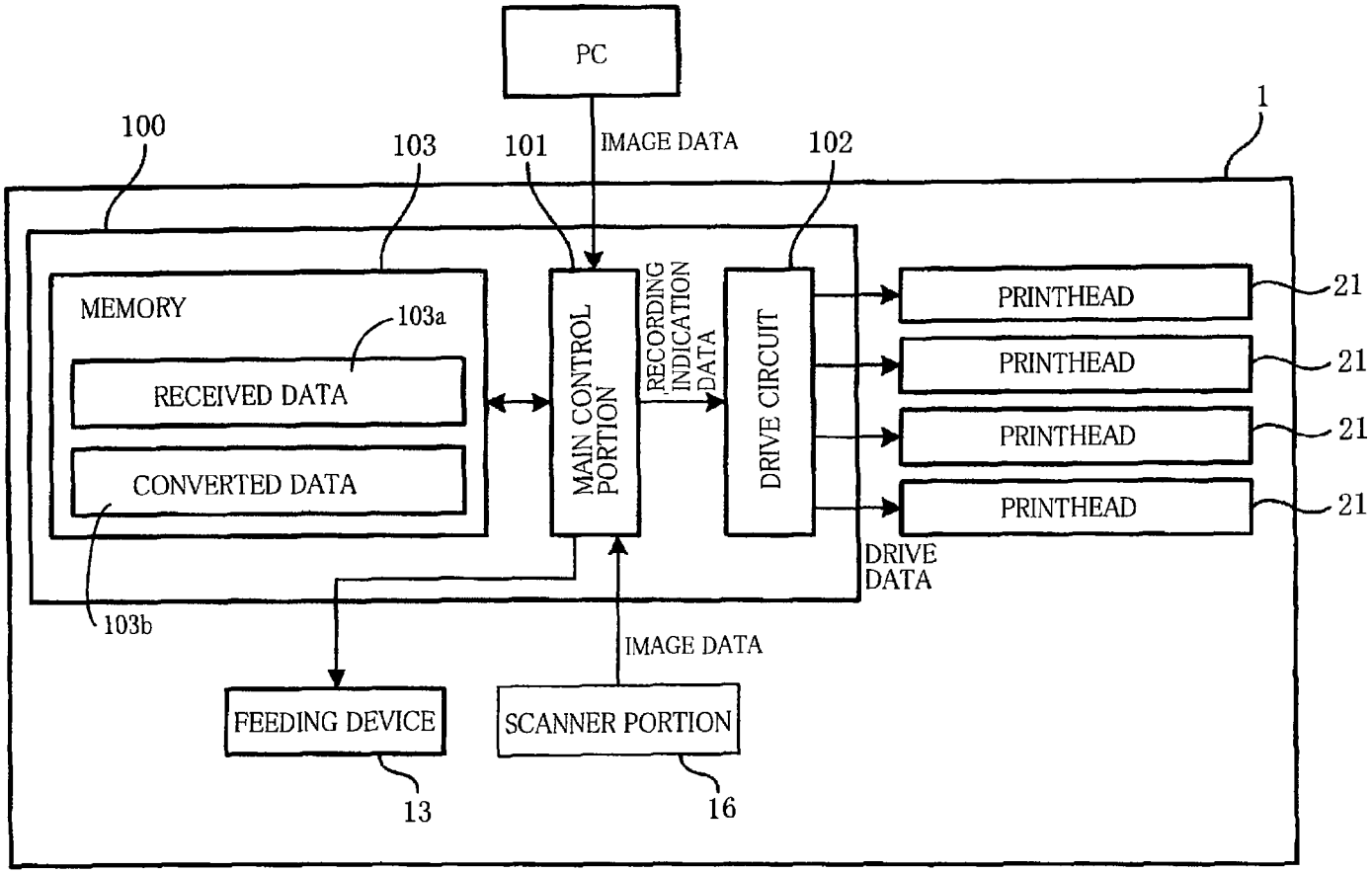
FIG. 2 is a block diagram schematically showing a structure of a MFD controller of the MFD shown in FIG. 1.

The MFD 1 further includes an MFD controller 100 which controls the feeding device 13 and the printheads 21 in order that a predetermined (designed) image is recorded on the recording sheet P. Hereinafter, the MFD controller 100 will be described with reference to FIG. 2.

Figure 3:
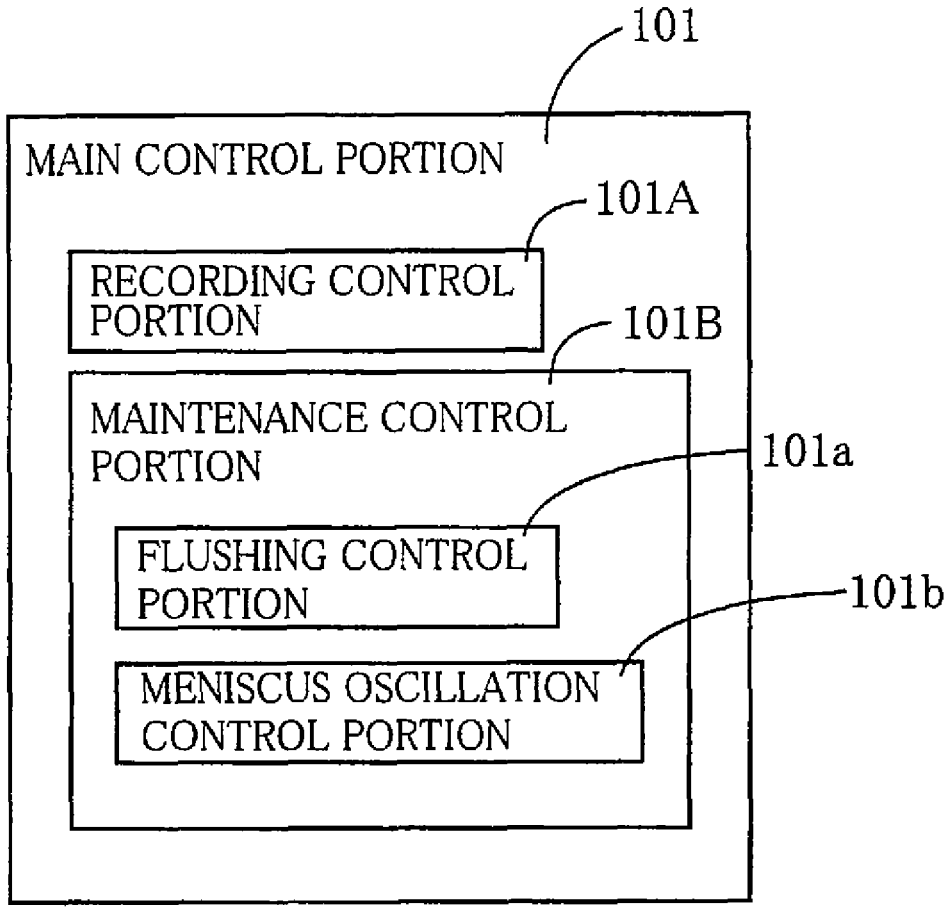
FIG. 3 is a functional block diagram showing a function of a CPU of the MFD controller shown in FIG. 2.

To the MFD 1, image data of an image to be recorded on the recording sheet P are transmitted from a personal computer (PC) and so on. MFD controller 100 includes a main control portion 101, and the main control portion 101 is constituted mainly by a computer including a CPU (Central Processing Unit), a ROM (Read Only Memory), a RAM (Random Access Memory), and an input/output interface. As shown in a functional block diagram of FIG. 3, the main control portion 101 functions as a recording control portion 101A, a maintenance control portion 101B and so on. The maintenance control portion 101B functions as a flushing control portion 101*a* and a meniscus oscillation control portion 101*b*. When the image data are transmitted to the main control portion 101 from the computer, the transmitted (received) image data are stored in a memory 103. The memory 103 has an area for storing the transmitted image data for a plurality of pages, and the received image data beyond a volume of the area are sequentially stored, following progressing of the image recording operation.

There are various types of formats of the image data, and in the present embodiment, the image data of a so-called vector type format are expected as the image data outputted from the PC. In the vector type format, contents of an image are described by (a) positional data which indicates an attribution of letters and figures that are included in the image to be recorded on the recording sheet P, (b) size data, (c) form (shape) data and so forth. In a main control portion 101, the image data of the vector type format are converted into that of a raster type format. More precisely, in the main control portion 101, the data indicating the attribution of letters and figures which are included in the transmitted image data stored in a memory area 103*a* are converted to data indicating a pixel arrangement of the image. Then, the converted data are stored in the memory area 103*b*. It is preferable that each of the memory areas 103*a*, 103*b* has a capacity for storing the image data corresponding to a plurality of pages. Each of the memory areas 103*a*, 103*b* may have a capacity corresponding to only one sheet, but in this case, it is preferable that the plurality of pages of the image data can be stored in the memory areas 103*a*, 103*b* by means of discarding the image data that are already used.

Image data of a image that is read by the scanner portion 16 are also transmitted to the main control portion 101 and stored in the memory 103. When the image data are of color, for improving a quality of recording, the read image data of a RGB multiple tone format are converted into those of a dotted format with the four colors of inks (CMYK). The above-mentioned data-converting operation is performed in one of the scanner portion 16 and the MFD controller 100. For example, when the data-converting operation is performed in the scanner portion 16, data indicating a pixel arrangement of the read image data are generated in the scanner portion 16, and the generated data are transmitted (supplied) to the MFD controller 100. By the main control portion 101, the image data that are transmitted from the scanner portion 16 are stored in the memory area 103*b* as read-image data in the form of the converted data.

The main control portion 101 transmits recording indication data to the drive circuit 102 based on the decoded data that are stored in the memory 103 or the read-image data. The recording indication data are data for indicating a volume of ink that is ejected from each of the nozzles 22 of respective one of the printheads 21 and a timing at which the ink is ejected therefrom. In the drive circuit 102, the drive data in order to eject an appropriate volume of inks at a timing that is indicated in the recording indication data transmitted from the main control portion 101 are generated and transmitted (supplied) to each of the printheads 21 (a drive-data supplying portion). Each of the nozzles 22 of each of the printheads 21 has an ejecting actuator, and the drive data are supplied from the drive circuit 102 to each of the ejecting actuator. By the ejecting actuator, the ink is ejected through each of the nozzles 22 based on the drive data transmitted from the drive circuit 102.

An ink that is ejected from one of the nozzles 22 based on one piece of the drive data forms one dot of the image on the recording sheet P. The drive data are sequentially supplied to each of the ejecting actuator at a predetermined recording cycle (period). Accordingly, while the recording sheet P is fed in the sheet feed direction, inks that are sequentially ejected from one of the nozzles 22 are ejected on the recording sheet P, arranged parallel to a line along the sheet feed direction. Therefore, in a case where the recording cycle is determined at a predetermined one, a resolution of the image with respect to the sheet feed direction is made lower as a feed speed of the recording sheet P is higher, and is made higher as the feed speed is lower.

In the main control portion 101, based on the decoded data (the read-image data) that are stored in the memory 103 and so on, the feed speed of the recording sheet P is determined in order to correspond to the resolution of the image in the sheet feed direction. Then, the drive data are supplied from the drive circuit 102 to the each of the printheads 21, and the feeding device 13 is controlled in order that the recording sheet P is fed to the recording area at the predetermined feed speed.

Figure 4:
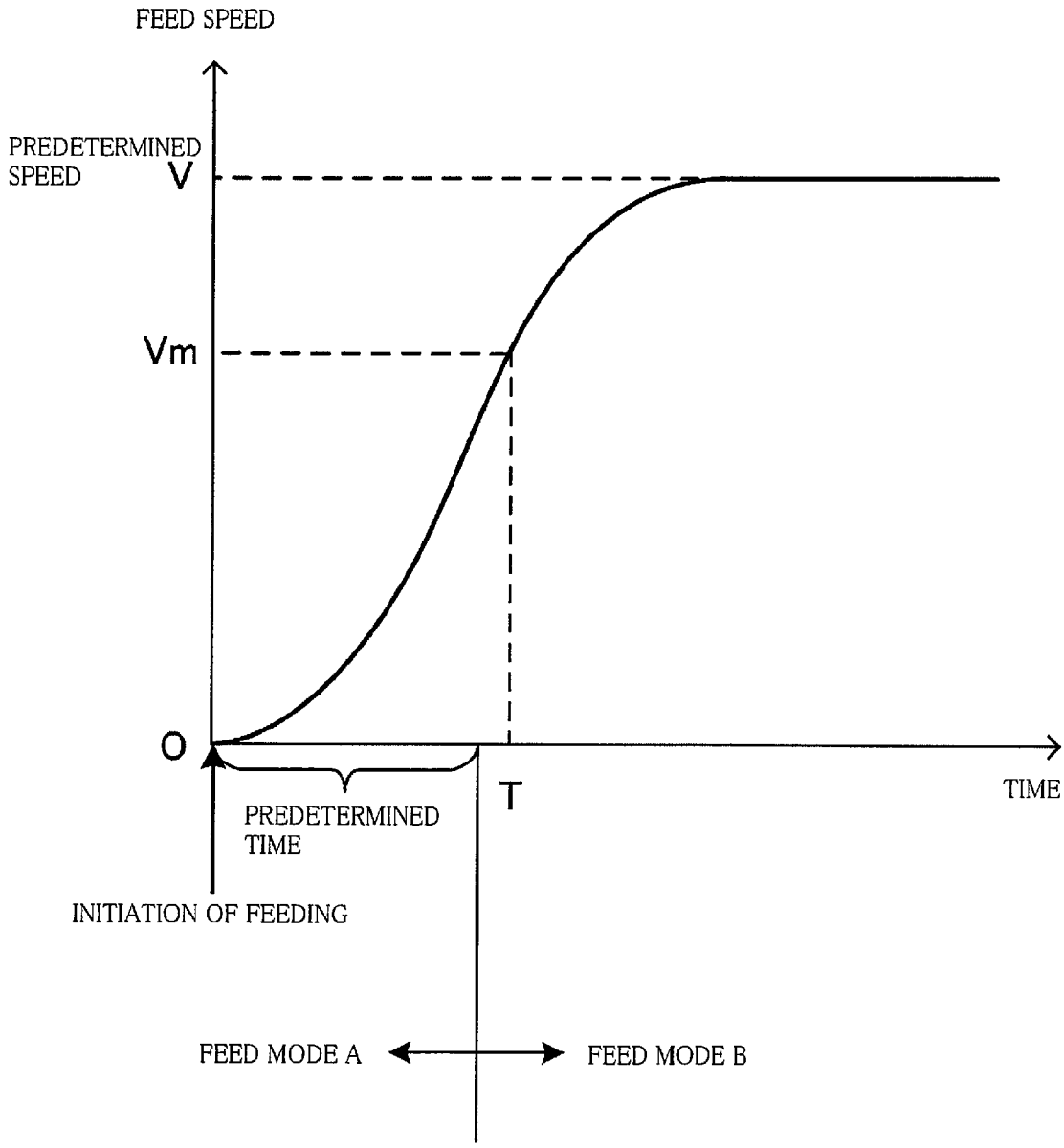
FIG. 4 is a graph showing a change of feed speed of recording sheets from an initiation of feeding until reaching a predetermined feed speed.

The main control portion 101 controls the feeding device 13 in order that the feed speed of the recording sheet P is changed as shown in a graph of FIG. 4. When feeding of the recording sheet is initiated, the feed speed of the recording sheet P is gradually accelerated. In the main control portion 101, in order that an image is recorded on the recording sheet at a predetermined resolution during an acceleration of the feed speed, a cycle for supplying the drive data from the drive circuit 102 to each of the printheads 21 is gradually made shorter (smaller) until reaching a predetermined value of cycle depending on a change of the feed speed. After the feed speed is accelerated to a predetermined speed V, the feeding device 13 feeds the recording sheet to pass through the recording area, maintaining at the predetermined speed V, and the recording cycle is kept at a predetermined value of cycle.

Further, the MFD controller 100 has the printheads 21 perform a flushing operation at a predetermined timing. The flushing operation is an operation in which inks are ejected from at least one of the printheads 21 whose ejecting surface 21*a* is not opposed to the recording sheet P, and bubbles are prevented from entering into each of the nozzles 22.

Furthermore, the MFD controller 100 has the printheads 21 perform a meniscus oscillating operation. The meniscus oscillating operation is an operation in which the drive data (non-ejecting drive data) that is adjusted in order not to eject the ink (a liquid) from the nozzles 22 of at least one of the printheads 21 are supplied to the printheads 21 such that a meniscus formed in the nozzles 22 is slightly oscillated. Therefore, a viscosity of the ink in the vicinity of the meniscus in the nozzles 22 is prevented from being increased. The meniscus oscillating operation is also performed at a timing at which each of the ejecting surfaces 21*a* of each of the printheads 21 is not opposed to the recording sheet P in order that the recording sheet P is prevented from becoming dirty, because it is possible that a tiny droplet of ink may be ejected when a temperature of the ink is high so that a viscosity of the ink is decreased.

In the MFD 1, one of the two recording modes that are different from each other in recording conditions can be selected in order to correspond to various recording conditions that differ from one another in a format of the image data, the feed speed, and so on.

For example, as shown in FIG. 5, one of a color-recording mode and a monochrome-recording mode can be selected. The either one of the color-recording mode and the monochrome-recording mode may be selected based on the contents of the image data transmitted from the PC or the scanner portion 16, or may be predetermined by a user.

Further, as shown in FIG. 6, either one of a high-speed feed mode in which the recording sheet P is fed at a high speed, and a low-speed feed mode in which the recording sheet P is fed at a low speed can be selected. In the present embodiment, these recording modes of the high-speed feed mode and the low-speed feed mode are switched depending on whether a recording sheet with a regular size is used as the recording sheet P or a recording sheet that is fed from the manual sheet-feed tray. The recording sheets with various sizes and made of various materials are fed from the manual sheet-feed tray, so that, when the recording sheet from the manual sheet-feed tray is fed at the same speed as the regular-sized recording sheet, it is highly possible that the recording sheet P from the manual sheet-feed tray may be fed improperly. Therefore, when the recording sheet P is fed from the manual sheet-feed tray, in the MFD controller 100, while the low-speed feed mode is selected, the recording cycle is made longer such that the image is recorded on the recording sheet P at a predetermined resolution. When the regular-sized recording sheet is used, in the MFD controller 100, the image is recorded on the recording sheet P at a regular (normal) recording cycle, while the high-speed feed mode is selected.

The high-speed feed mode and the low-speed feed mode are switched depending on a resolution of the image to be recorded on the recording sheet P. For example, the MFD controller 100 performs an operation in which the image is recorded on the recording sheet P at a resolution that is higher than that in the high-speed feed mode by means that the image is recorded on the recording sheet P in the low-speed feed mode and at the same recording cycle as that in the high-speed feed mode.

Furthermore, as shown in FIG. 7, in the MFD 1, either one of a printer mode in which an image is recorded on the recording sheet P based on the image data that are transmitted from the PC, and a copier mode in which an image is recorded on the recording sheet P based on the image data that are transmitted from the scanner portion 16 can be selected.

Figure 8A:
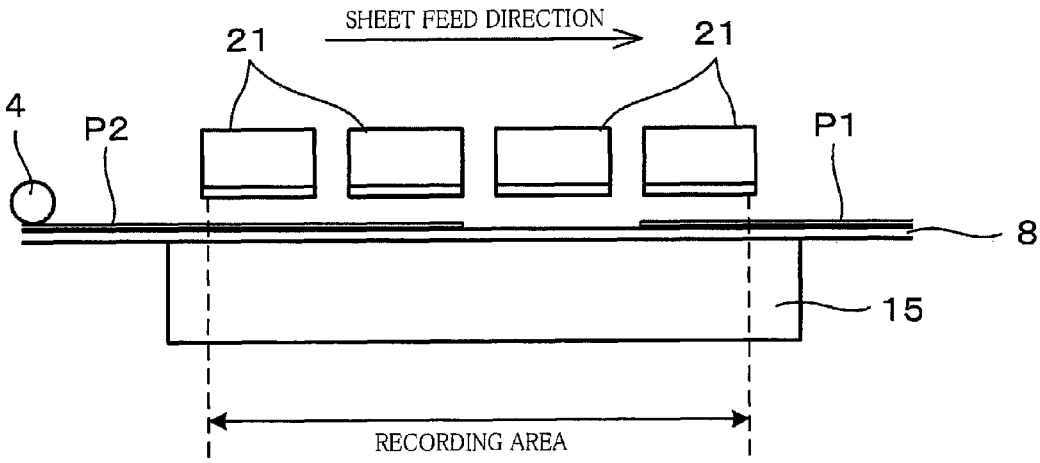
FIG. 8A is a side view of the MFD when a feeding device shown in FIG. 1 feeds the recording sheets to a recording area in the feed mode A.
Figure 8B:
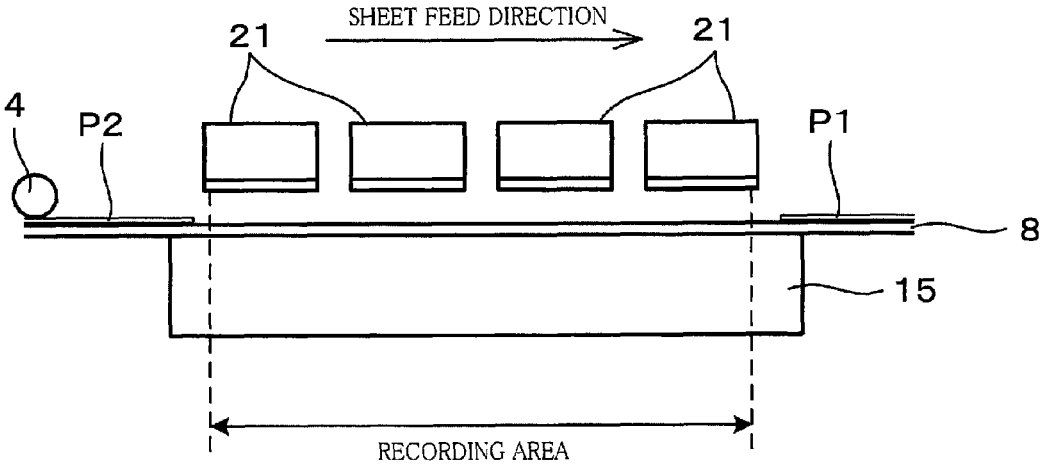
FIG. 8B is a side view of the MFD when the feeding device shown in FIG. 1 feeds the recording sheets to the recording area in the feed mode B.

In an image recording apparatus such as the MFD 1 in the present embodiment, in order to enhance throughput of the recording operation, for example, it can be considered that a distance between a trailing end of a preceding recording sheet P1 and a front end of a following recording sheet P2 which is fed next to the preceding recording sheet P1 is made as small as possible. FIGS. 8A and 8B show two different examples in which respective distances between the preceding recording sheet P1 and the following recording sheet P2 are different from each other. In FIG. 8B, the distance between the trailing end of the preceding recording sheet P1 and the front end of the following recording sheet P2 is larger than a dimension of the recording area in the sheet feed direction. Meanwhile, in FIG. 8A, the distance between the trailing end of the preceding recording sheet P1 and the front end of the following recording sheet P2 is smaller than a dimension of the recording area in the sheet feed direction. When respective other recording conditions of the two examples are identical with each other, a case where the recording sheets P1, P2 are fed as shown in FIG. 8A can enhance throughput of recording of images on the plurality of recording sheets P, compared to a case shown in FIG. 8B.

When the preceding recording sheet P1 and the following recording sheet P2 are fed to the recording area in such a manner as shown in FIG. 8A, there is needed a structure for concurrently recording respective images on the recording sheets P1, P2. Therefore, the drive data for the following recording sheet P2 should be supplied to each of the printheads 21 before the preceding recording sheet P1 passes through the recording area. On the other hand, times necessary for supplying the drive data for one recording sheet vary depending on the recording conditions such as the format of the drive data and the feed speed.

For example, in a case of the two recording modes shown in FIG. 5, a time necessary for supplying the drive data for the one recording sheet to the printheads 21 in the color-recording mode tends to become longer than that in the monochrome-recording mode, because in the color-recording mode, a data amount of the image data that are transmitted from the PC and so on, and the drive data to be supplied to the printheads 21 are larger than those in the monochrome-recording mode. Especially, in a case where the data amount of the image data that are transmitted from the PC is large, when a plurality of pages of the image data are recorded on the recording sheets P, the memory 103 cannot store all the image data together, so that it is likely that the image data are divided into several pieces and that those divided pieces of the image data are sequentially stored in the memory 103. In this case, it takes a long time that the transmitted image data are stored in the memory 103. Further, when the amount of the transmitted image data is large, it also takes a long time that the transmitted image data are converted in the main control portion 101.

Therefore, in the color-recording mode, it is likely that the drive data for the following recording sheet P2 cannot be supplied to the printheads 21 at a timing at which the following recording sheet P2 is fed to the recording area next to the preceding recording sheet P1.

In order to solve the above-mentioned problem, for example, it can be considered that the image data are processed at a higher speed, or that a volume of the memory 103 is increased such that an amount of the image data to be stored is made larger. However, the above-mentioned ways are likely to cause to complex processing of the image data and increase a cost of the apparatus.

It can be also considered that, when the drive data for the following recording sheet P2 cannot be supplied to the printheads 21 in the color-recording mode, the recording operation is temporarily stopped until the drive data is decoded and transmitted to the printheads 21. In this case, since a distance in the sheet feed direction between the preceding recording sheet P1 and the following recording sheet P2 is not always unchangeable (fixed), it sometimes gives an impression on the user that the recording operation is slowly performed.

Accordingly, in the present embodiment, the MFD controller 100 is provided so as to select one of two feed modes, a and a feed mode B, which are different from each other in feed timings at which the recording sheets are fed one by one to the recording area (a timing selecting portion). When the main control portion 101 selects a timing of the feed mode A (a first feed timing), the feeding device 13 is controlled such that respective images can be concurrently recorded on the trailing end portion of the preceding recording sheet P1 and the front end portion of the following recording sheet P2 at the recording area. In other words, the feeding device 13 is controlled to feed the recording sheets P1, P2 as shown in FIG. 8A. When the main control portion 101 selects a timing of the feed mode B (a second feed timing), the feeding device 13 is controlled such that an image is concurrently recorded on one of the recording sheets P at the recording area. In other words, the feeding device 13 is controlled so as to feed the recording sheets P as shown in FIG. 8B (a feed control portion).

The MFD controller 100 selects either one of the feed mode A and the feed mode B depending on whether the monochrome-recording mode or the color-recording mode is selected. More precisely, the feed mode A is selected in a case of the monochrome-recording mode, and the feed mode B is selected in a case of the color-recording mode. Therefore, in the color-recording mode in which it tends to take a longer time to supply the drive data to the printheads 21, compared to the monochrome-recording mode, the image is concurrently recorded on one of the recording sheets P, so that it is not always necessary to restrict the recording conditions in order to supply the drive data to the printheads 21 in time. For example, the feed timings at which the recording sheets P are sequentially fed one by one are not necessary to be delayed. Further, it is unnecessary that processing of the data is performed at a high speed such that the drive data can be supplied to the printheads 21 in time, and that the volume of the memory 103 is increased. Moreover, since the respective images can be concurrently recorded on the recording sheets P1 and P2 in the monochrome-recording mode, leading to enhancing the throughput.

The MFD controller 100 may select one of the feed modes A, B depending on whether the low-speed feed mode or the high-speed feed mode is selected as shown in FIG. 6. The feed mode A is selected in a case of the low-speed feed mode, while the feed mode B is selected in a case of the high-speed feed mode. When the recording sheet P is fed from the manual feed tray, and (or) when the image is recorded on the recording sheet P at a high resolution, the low-speed feed mode is selected. In this case, the feed speed of the recording sheet P is decreased, so that the drive data is possibly supplied to the printheads 21 in time, compared to the case of the high-speed feed mode. Therefore, the feed mode A is appropriately selected so as to enhance the throughput. Furthermore, since the feed mode B is selected in the high-speed feed mode, it is unnecessary to restrict the recording conditions and perform the data processing at a high speed.

The MFD controller 100 may select the either one of the feed modes A, B depending on whether the copier mode or the printer mode is selected as shown in FIG. 7. The feed mode A is selected in a case of the copier mode, while the feed mode B is selected in a case of the printer mode. In the copier mode, the images that are read by the scanner portion 16 are recorded on the plurality of recording sheets P. More precisely, once the image data are stored in the memory 103, in most cases, based on identical image data, identical drive data are supplied to the printheads 21 with respect to the plurality of recording sheets P. Further, the image data that are read by the scanner portion 16 are stored in the memory 103 in the form of the raster type data. Therefore, it is unnecessary to covert the vector type data into the raster type data as in the printer mode, so that the drive data can be transmitted in a shorter time. It is applicable to a case in which the images differ from each other are sequentially copied one by one.

That is, in the copier mode, a time necessary for supplying the drive data for one recording sheet P is shorter (smaller) than that in the printer mode, and when the feed mode A is selected, it is unlikely that the drive data cannot be supplied in time, compared to the printer mode. Accordingly, the feed mode A is appropriately selected in the copier mode so as to enhance the throughput. Further, since the feed mode B is selected in the printer mode, it is unnecessary to restrict the recording conditions and perform the data processing at a high speed.

Figure 9:
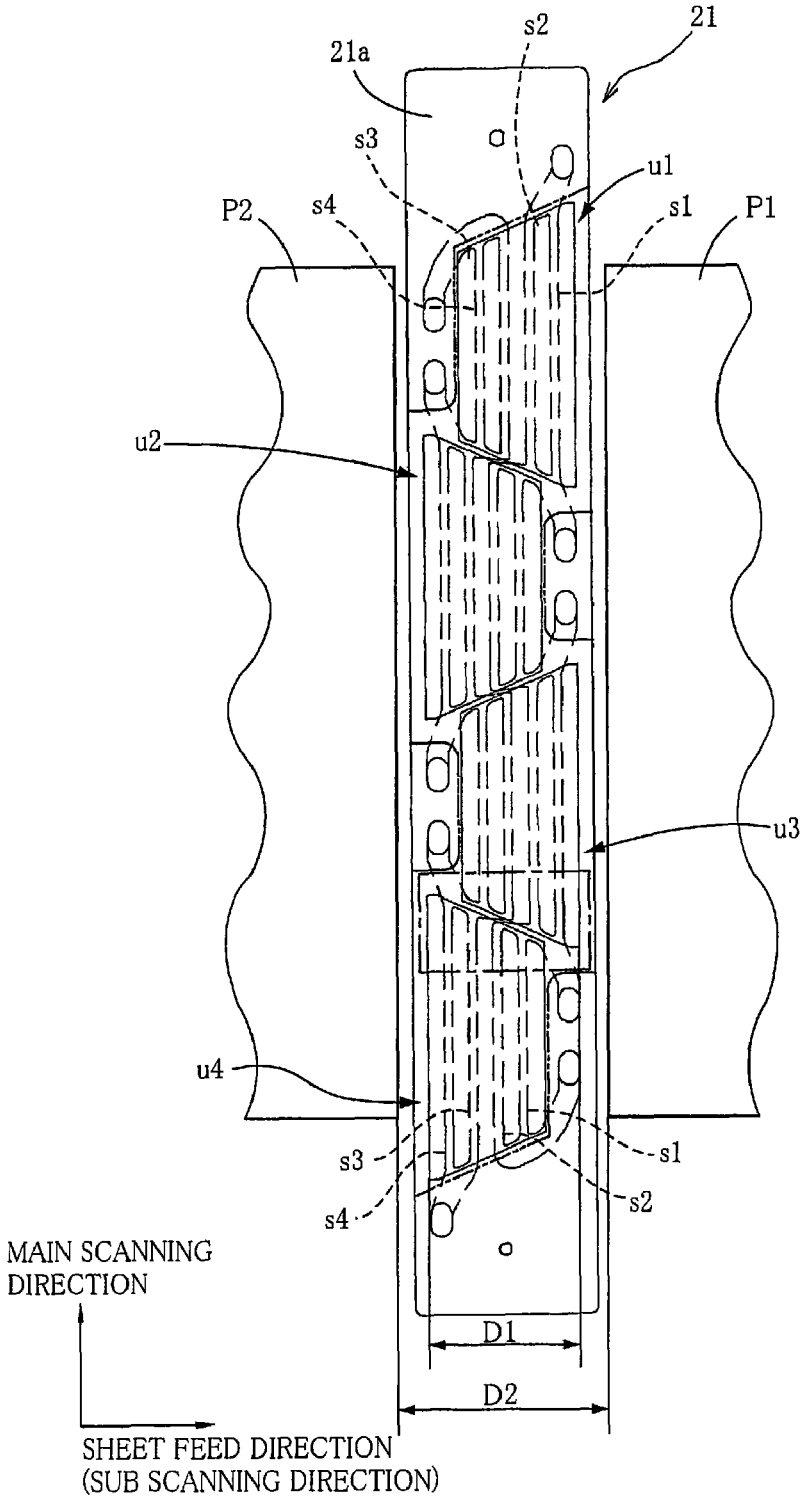
FIG. 9 is an illustrative view showing a state of feeding of the recording sheets during an operation of a meniscus oscillation control portion shown in FIG. 3.
Figure 10:
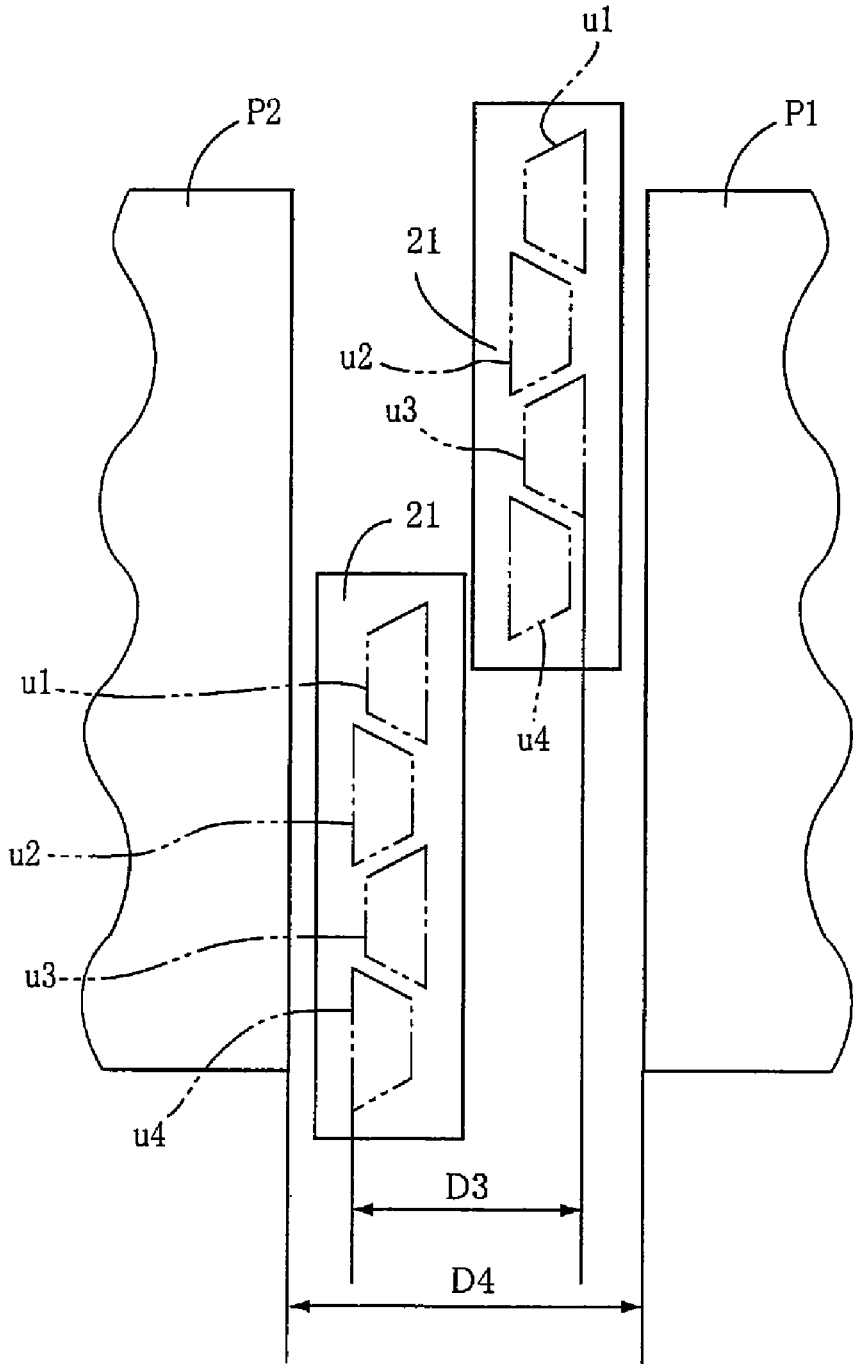
FIG. 10 is an illustrative view showing another state of feeding of the recording sheets during an operation of the meniscus oscillation control portion shown in FIG. 3.

The MFD controller 100 has the feeding device 13 feed the recording sheets P one by one such that the preceding recording sheet P1 and the following recording sheet P2 are spaced from each other as shown in FIG. 8A. For example, the recording sheets P are fed by the feeding device 13 in order that the preceding recording sheet P1 and the following recording sheet P2 are spaced from each other at a distance in the sheet feed direction which is equal to or larger than a distance that corresponds to a dimension of one printhead 21 in the sheet feed direction. As schematically shown in FIG. 9, in the ejecting surface 21*a* of the printhead 21, four nozzle units u1, u2, u3, u4 are formed. Each of the four nozzle units u1, u2, u3, u4 consists of four nozzle sets s1, s2, s3, s4, and each of the four nozzle sets s1, s2, s3, s4 consists of four nozzle rows. Accordingly, the above-mentioned "the dimension of one printhead 21 in the sheet feed direction" is a dimension D1 of a distance in the sheet feed direction between a most upstream one and a most downstream one of the nozzles 22 of the printhead 21 with respect to the sheet feed direction. The recording sheets P1, P2 are fed by the feeding device 13 in order that a dimension D2 of the distance between the trailing end of the preceding recording sheet P1 and the front end of the following recording sheet P2 is larger than the dimension D1. When each of the recording sheets P1, P2 has a large width in a main scanning direction or a direction perpendicular to the sheet feed direction, it is difficult for one printhead 21 to record respective images on the recording sheets P1, P2. Therefore, as shown in FIG. 10, a plurality of printheads 21 of one group record the respective images on the recording sheets P1, P2. In this case, the nozzles 22 of the printheads 21 are arranged in a way that, as if the plurality of printheads 21 are one printhead 21, respective nozzles 22 of the printheads 21 are spaced at an equal distance with respect to the direction perpendicular to the sheet feed direction, and respective portions of the printheads 21 adjacent to each other overlap with each other in a lengthwise direction of the printhead 21 (a main scanning direction). In this case, the recording sheets P1, P2 are fed by the feeding device 13 in order that a dimension D4 of the distance between the trailing end of the preceding recording sheet P1 and the front end of the following recording sheet P2 is larger than a dimension D3 of a distance between a most upstream one of the nozzles 22 of a most upstream one of the printheads 21 and a most downstream one of the nozzles 22 of a most downstream one of the printheads 21 in the sheet feed direction. When either one of the feed mode A and the feed mode B is selected, at a timing at which the recording sheet P is not opposed to the ejecting surface or surfaces 21*a* of the printhead or printheads 21, one of the flushing operation and a meniscus oscillating operation is performed with respect to the printhead or printheads 21 by respective one of the flushing control portion 101*a* and a meniscus oscillation control portion 101*b*. As mentioned above, even in the feed mode A, the recording sheets P are fed in order that the trailing end of the preceding recording sheet P1 and the front end of the following recording sheet P2 are spaced from each other at a distance in the sheet feed direction which is equal to or larger than a distance that corresponds to a dimension of one printhead 21 or one group of printheads in the sheet feed direction. Therefore, in the feed mode A, the flushing operation and the meniscus oscillating operation are appropriately performed. Further, the recording sheets P are prevented from becoming dirty by ejected ink.

It is preferable that each of the flushing operation and the meniscus oscillating operation is performed with respect to all the nozzles 22 of one printhead 21 or one group of printheads at one time. It is also preferable that in the feed mode A, a dimension of the distance between the preceding recording sheet P1 and the following recording sheet P2 includes a dimension of one printhead 21 or one group of printheads in the sheet feed direction and a dimension which corresponds to a time necessary for ejecting inks through the nozzles 22 in the flushing operation and for the inks to be received on the feed belt 8.

Hereinafter, reference is made to a flow chart in FIG. 1*s* illustrating a recording control operation implemented by the MFD controller 100.

First, when the MFD controller 100 initiate receiving the image data from the PC or the scanner portion 16 in step S1, the recording conditions such as the resolution of the image, the feed speed of the recording sheet P, and the format of the image (monochrome/color, and so on) are determined based on the received image data and the predetermined recording modes (step S2).

Next, in the MFD controller 100, one of the feed mode A and the feed mode B is selected based on the predetermined recording modes (steps S3, S4, and S9). For example, in a case where the feed mode A or the feed mode B is selected on the basis of the recording modes shown in FIG. 5, when the monochrome-recording mode is selected (step S3, and A decision), the feed mode A is selected (step S9). When the color-recording mode is selected (step S3, and B decision), the feed mode B is selected (step S4).

Figure 11:
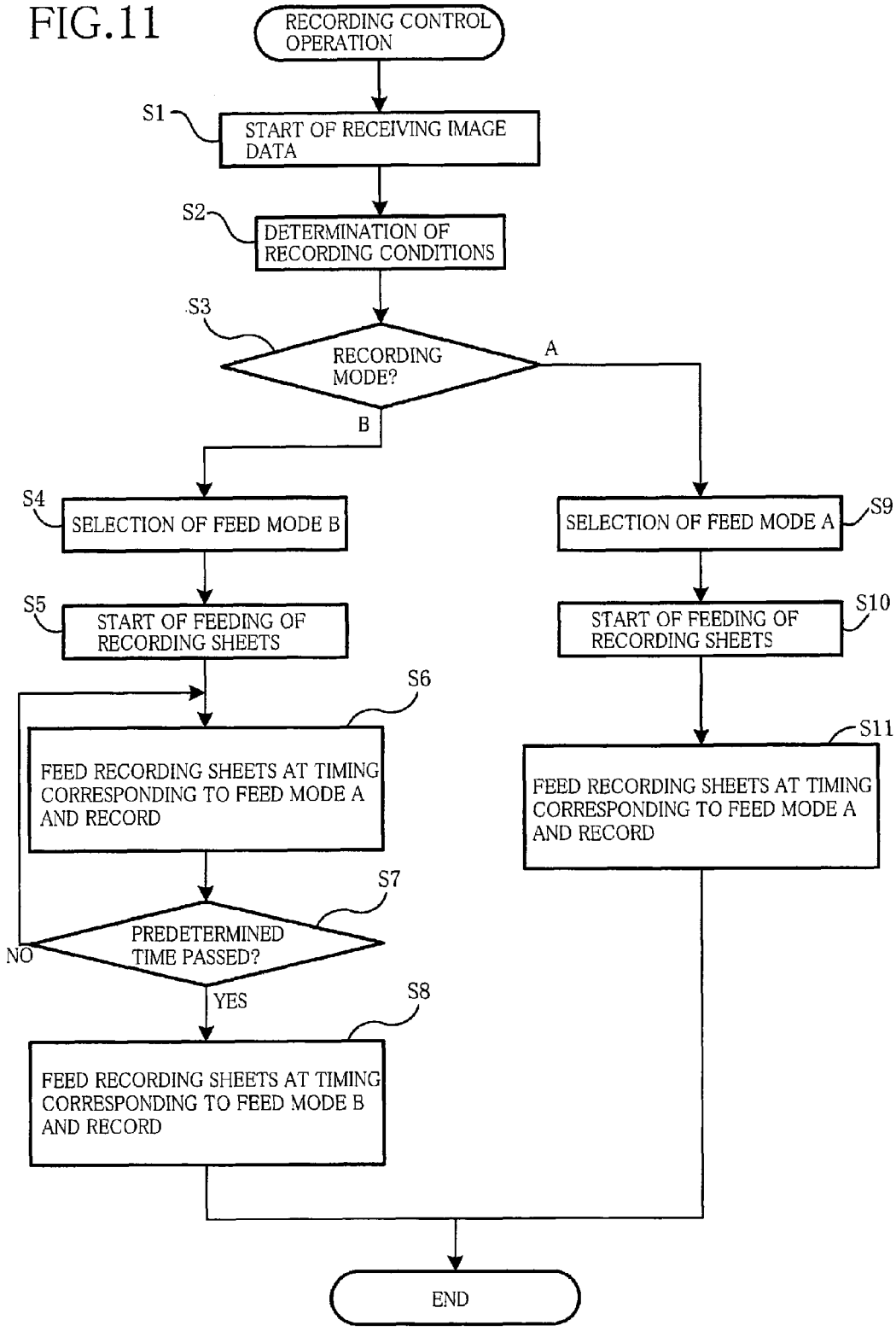
FIG. 11 is a flow chart illustrating a recording control operation implemented by the MFD controller shown in FIG. 1.

When the feed mode B is selected, the following steps are implemented. In step S5, the MFD controller 100 has the feed device 13 initiate feeding of the recording sheets P. In the present embodiment, the MFD controller 100 performs an operation for generating the drive data while decoding the received image data, in parallel with the operation shown in FIG. 11, such that the drive data is appropriately supplied to the printheads 21 corresponding to the feeding of the recording sheets P.

In step S6, the MFD controller 100 has the feeding device 13 accelerate to feed the recording sheets P to the feed speed V that is determined in step S2, and perform the recording operation to record an image on the recording sheet P. Even in a case where the feed mode A cannot be selected at the predetermined speed V, the feed mode A can be selected during a period at which the feed speed is small right after the feeding of the recording sheet P is initiated. Therefore, the MFD controller 100 has the feeding device 13 feed the recording sheets P at a timing corresponding to the feed mode A during a predetermined time period until reaching a feed speed Vm (<V, or that is smaller than the feed speed V), and performs the recording operation (steps S6, S7).

More precisely, the feed speed Vm is the largest feed speed at which the drive data for the following recording sheet P2 can be supplied to the printheads 21 before the preceding recording sheet P1 passes through the recording area. When t1 represents a time necessary for the preceding recording sheet P1 to pass through the recording area and t2 represents a time necessary for the MFD controller 100 to supply the printheads 21 with the drive data for the following recording sheet P2, the feed speed Vm represents the largest feed speed so as to establish a first condition $t1 \geqq t2$, or t1 is equal to or larger than t2. In other words, since the first condition $t1 \geqq t2$ is established until the feed speed becomes over (exceeds) the feed speed Vm, the drive data for the following recording sheet P2 can be supplied to the printheads 21 before the preceding recording sheet P1 passes through the recording area, and the feed mode A can be selected. On the other hand, when the feed speed exceeds the feed speed Vm, a second condition $t1 < t2$, or t1 is smaller than t2, is established, so that the drive data for the following recording sheet P2 cannot be supplied to the printheads 21 before the preceding recording sheet P1 passes through the recording area. Therefore, the recording sheets P can be fed at the feed mode A right after initiating of feeding of the recording sheets P, however, the feed mode A should be switched (changed) to the feed mode B before passing of a time T (shown in FIG. 4) at which the feed speed exceeds the feed speed Vm.

In the present embodiment, the time t1 is determined depending on the feed speed of the recording sheets P. The t2 represents a time necessary for the MFD controller 100 to decode the received image data from the PC and so on, generate the drive data based on the decoded image data, and supply the drive data to the printheads 21. In other words, t2 is determined depending on the recording conditions such as the format and the resolution of the image, which are determined in step S2, and a performance of the MFD controller 100 to process data. Therefore, when the recording conditions are determined in step S2, the feed speed Vm can be set, and the time T can be determined based on an acceleration curve shown in FIG. 4.

Based on the recording conditions that are determined in step S2, the MFD controller 100 determines a predetermined time (shown in FIG. 4) that is smaller than the time T. When the feeding of the recording sheets P is initiated, the MFD controller 100 has the feeding device feed the recording sheets P at the timing corresponding to the feed mode A, and performs the recording operation (step S6). Then, in the MFD controller 100, it is determined whether the predetermined time has passed (step S7). When the negative decision (No) is obtained in step S7, step S6 is repeatedly implemented. When the affirmative decision (Yes) is obtained in step S7, in step S8, the MFD controller 100 has the feeding device 13 accelerate to feed the recording sheets P at the timing corresponding to the feed mode B, and performs the recording operation. When the feed speed reaches the predetermined feed speed V, the MFD controller 100 has the feeding device 13 feed the recording sheets P constantly at the predetermined speed V, and performs the recording operation. When all of the recording operations are finished, the MFD controller 100 ends the recording control operation.

When the feed mode A is selected in steps S3, S9, the MFD controller 100 has the feeding device 13 initiate feeding of the recording sheets P (step S10). In step S11, the MFD controller 100 has the feeding device 13 feed the recording sheets P at the timing corresponding to the feed mode A and accelerate to feed the recording sheets P to the predetermined speed V, and performs the recording operation at the feed mode A without changing to the feed mode B. When all of the recording operations are finished, the MFD controller 100 ends the recording control operation.

In the present embodiment, even when the feed mode B is selected, right after the feeding of the recording sheets P is initiated, the feed mode A is selected, leading to enhancing the throughput.

Hereinafter, there will be described a second embodiment of the present invention with reference to FIG. 12. In the illustrated embodiment as a first embodiment, for example, when the monochrome-recording mode (shown in FIG. 5) is selected, all the recording sheets P to be recorded are fed at the timing corresponding to the feed mode A, and the respective images are recorded on each of the recording sheets P. In some cases, however, the drive data for the recording sheets P to be supplied to the printheads 21 are different from each other. In this case, in order that the drive data for the following recording sheet P2 are supplied to the printheads 21 before the preceding recording sheets P1 passes through the recording area, it is necessary that the recording conditions such as the feed speed are determined after the longest time necessary for supplying the drive data to the printheads 21 is presumed, causing to restrict the recording conditions.

In the second embodiment, even after the feed mode A is selected, it is determined whether it takes a long time to supply the drive data to the printheads 21 with respect to each of the recording sheets P, and based on a result of determination, it is determined whether the recording sheet P is fed at the timing corresponding to the feed mode A or the feed mode B.

Figure 12:
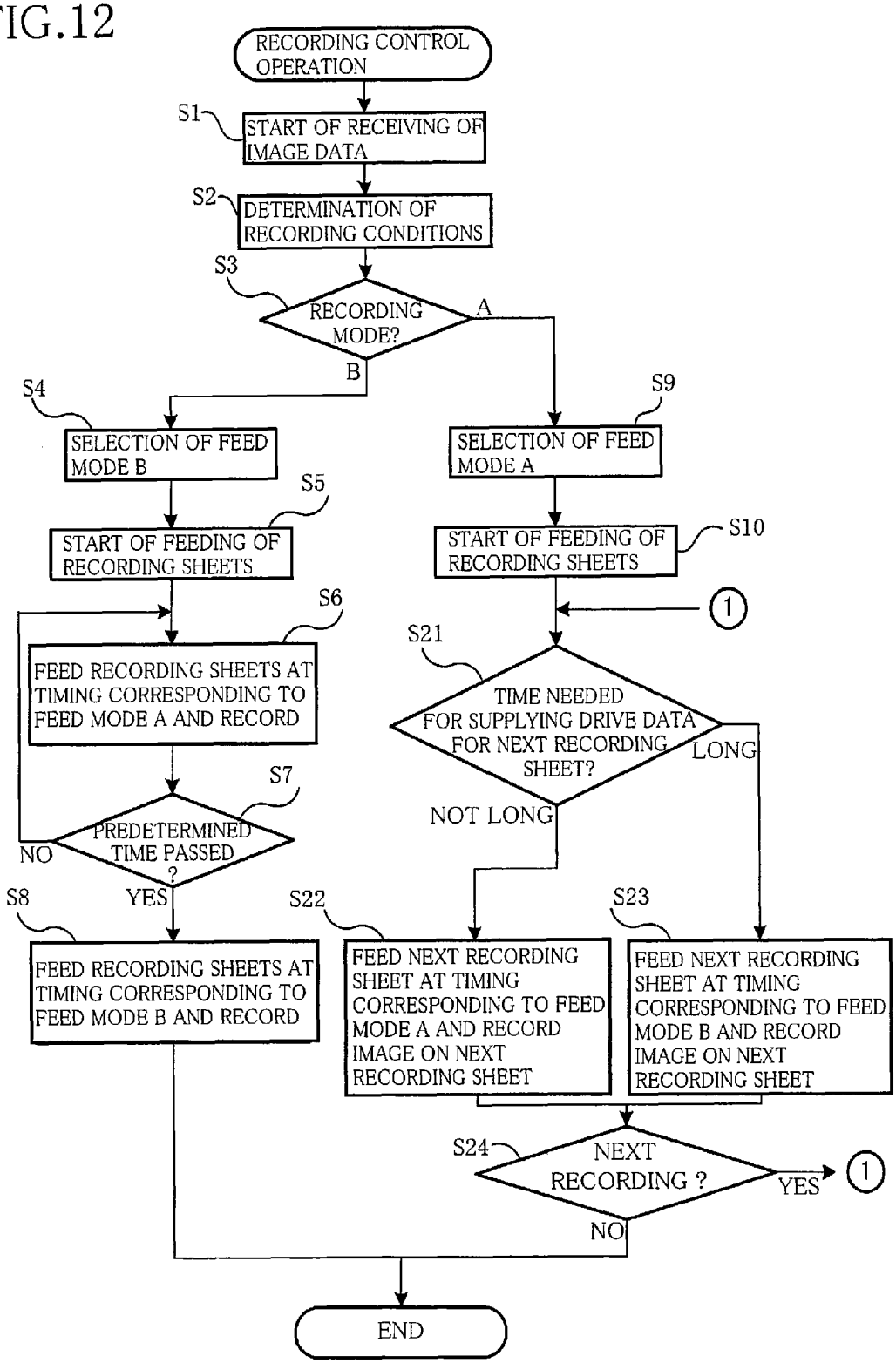
FIG. 12 is a flow chart illustrating a recording control operation implemented by a MFD controller as another embodiment (a second embodiment) to which the present invention is applied.

More precisely, in the second embodiment, the MFD controller 100 performs a recording control operation that is illustrated in a flow chart of FIG. 12. The flow chart of FIG. 12 includes steps S1 through S10 that are identical with those in the first embodiment. The recoding control operation in the second embodiment is different from that in the first embodiment in steps after the feeding of the recording sheets P is initiated in step S10, when the feed mode A is selected in step S9.

In step S21, the MFD controller 100 determines whether the time necessary for supplying the drive data for the following recording sheet P2, which is fed next to the preceding recording sheet P1 that is now initiated to be fed, to the printheads 21 is long or not.

More precisely, the MFD controller 100 compares a data amount of the received image data for the following recording sheet P2 that is received from the PC and so on, with a threshold. As shown in FIG. 13, when the data amount of the received image data is larger than the threshold (received data amount is large), it is determined that the time necessary for supplying the drive data for the following recording sheet P2 is long (step S21: YES). When the data amount thereof is equal to or smaller than the threshold (received data amount is small), the time necessary for supplying the drive data for the following recording sheet P2 is not long (step S21: NO). The threshold is determined such that, when the data amount of the received image data is equal to or smaller than the threshold, the drive data for the following recording sheet P2 can be surely supplied to the printheads 21 before the preceding recording sheet PI passes through the recording area. In other words, in the case where the data amount of the received image data is equal to or smaller than the threshold, the time t1 that is necessary for the preceding recording sheet P1 to pass through the recording area is set to become equal to or larger than the time t2 that is necessary for the MFD controller 100 to convert the received image data, generate the drive data from the converted image data, and supply the drive data to the printheads 21. The threshold is determined based on the recording conditions that are set in step S2, and a performance of the MFD controller 100 to process data and so forth.

Further, the following mode may be adopted. As shown in FIG. 14, when the image to be recorded on the preceding recording sheet P1 that is now fed to the recording area and the image to be recorded on the following recording sheet P2 are different from each other (different images), the time necessary for supplying the drive data to the printheads 21 is determined to be long (step S21: LONG), and the feed mode B is selected. When the image to be recorded on the preceding recording sheet P1 and the image to be recorded on the following recording sheet P2 are identical with each other (identical images), the time necessary for supplying the drive data to the printheads 21 is determined not to be long (to be short) (step S21: NOT LONG), and the feed mode A is selected. When the identical images are sequentially recorded on two recording sheets P (the preceding and the following recording sheets P1, P2), the respective drive data for the two recording sheets P are generated based on the converted image data that are stored in the memory 103 and are identical with each other. Therefore, it is not necessary that the image data received from the PC are repeatedly converted, so that it does not take a longer time to supply the drive data to the printheads 21, compared to a case where the different images are respectively recorded on the two recording sheets P.

In step S21, when it is determined that the time necessary for supplying the drive data for the following recording sheet P2 to the printheads 21 is long (step S21: YES), the MFD controller 100 has the feeding device 13 feed the following recording sheet P2 at the timing corresponding to the feed mode B, and performs the recording operation to one recording sheet (preceding recording sheet P1) (step S23). In step S21, when it is determined that the time necessary for supplying the drive data for the following recording sheet P2 to the printheads 21 is short (step S21: NO), the MFD controller 100 has the feeding device 13 feed the following recording sheet P2 at the timing corresponding to the feed mode A, and performs the recording operation to the preceding recording sheet P1 (step S22).

In step S24, the MFD controller 100 determines whether there is another recording sheet P to be next recorded. When it is determined that there is another recording sheet P to be next recorded (step S24: YES), the steps followed by step S21 are repeated. When it is determined that there is no recording sheet P to be next recorded (step S24: NO), an implementation of the recording control operation is ended after recording the image on the last recording sheet P.

In the second embodiment, once the feed mode A is selected, it is determined whether it takes a long time to supply the drive data for each of the recording sheets P, and the feed mode A or the feed mode B is selected based on a result of determination. Therefore, since one of the feed modes A, B can be appropriately selected with respect to each of the recording sheets P, the recording conditions are not necessarily restricted and the throughput can be enhanced.

The illustrated embodiments are preferred embodiments of the present invention, however, the present invention is not limited to the illustrated embodiments only. It is to be understood that the present invention may be embodied with various changes and improvements that may occur to a person skilled in the art, without departing from the spirit and scope of the invention defined in the appended claims.

For example, in the illustrated embodiments, one of the feed mode A and the feed mode B is selected on the basis of either of the recording modes illustrated in FIGS. 5 through 7. The feed mode A or the feed mode B may be selected on the basis of a combination of the recording modes. For example, instead of selecting the feed mode A in the case of the monochrome-recording mode only, the feed mode A may be selected when both of the monochrome-recording mode and the low-speed feed mode are selected.

Further, in the second embodiment, once the feed mode A is selected based on selecting of the recording modes, the time necessary for supplying the drive data is determined with respect to each of the recording sheets P, and based on a result of determination, one of the feed mode A and the feed mode B is selected. Instead of this, the feed mode A or the feed mode B may be selected only based on a result that the time necessary for supplying the drive data is determined with respect to each of the recording sheets P.

Furthermore, in the illustrated embodiments, the resolution of the image is changed mainly by changing the feed speed of the recording sheet P. Instead of changing the feed speed, the resolution of the image may be changed by changing a recording cycle. In this case, the feed mode A can be selected in a case of a mode with low resolution, while the feed mode B can be selected in a case of a mode with high resolution.

In the illustrated embodiments, one printhead 21 corresponds to one color of ink, and the plurality of printheads 21 are aligned with each other in the sheet feed direction. The present invention may be applied to an image recording apparatus which has a plurality of printheads arranged in two rows or more along the sheet feed direction and in a zigzag or a staggered manner (see FIG. 10). In this case, it is preferable that in the feed mode A, the trailing end of the preceding recording sheet and the front end of the following recording sheet are spaced from each other at a distance in the sheet feed direction which is equal to or larger than a distance that corresponds to a dimension in the sheet feed direction of a most upstream one and a most downstream one of the plurality of printheads corresponding to one color of ink. In the illustrated embodiment, even in a case where the feed mode B is selected, the feed mode A is selected right after feeding of the recording sheets P is initiated. In addition, the feed speed may be similarly controlled when it is necessary to change the feed speed during the recording operation. For example, in a case where it is necessary for the feed speed to be decelerated during the recording operation, the feed mode A may be selected when the feed speed is decelerated to a certain speed.

What is claimed is:

1. An image recording apparatus comprising:

a plurality of line-type printheads which are disposed parallel to one another and arranged in a medium feed direction, the printheads recording an image on each of a plurality of recording media which are sequentially fed one by one in the medium feed direction;

a feeding device which sequentially feeds the recording media to a recording area, two opposite ends of which in the medium feed direction respectively correspond to a most upstream one and a most downstream one of the printheads;

a drive-data supplying portion which generates a plurality of pieces of drive data for driving the printheads on the basis of image data of the image to be recorded on the recording medium, and supplies the pieces of drive data to the respectively corresponding printheads; and a feed control portion which has the feeding device initiate feeding of one of the recording media as a following recording medium which is fed next to another recording medium as a preceding recording medium, (i) at a first feed timing in order that a distance between a trailing end of the preceding recording medium and a front end of the following recording medium becomes smaller than a dimension of the recording area in the medium feed direction, when the drive-data supplying portion can supply the drive data to the printheads at a concurrent-recording enabling timing at which it is possible to concurrently record, at the recording area, an image on a trailing end portion of the preceding recording medium and an image on a front end portion of the following recording medium, and (ii) at a second feed timing in order that the distance between the trailing end of the preceding recording medium and the front end of the following recording medium becomes equal to or larger than the dimension of the recording area in the medium feed direction, when the drive-data supplying portion cannot supply the drive data to the printheads at the concurrent-recording enabling timing wherein the image recording apparatus further comprises a first mode selecting portion configured to select one of a first mode and a second mode which are different from each other in a time necessary for each of the recording medium to pass through the recording area, depending on a time necessary for the drive-data supplying portion to supply the printheads with the drive data for each recording medium, and wherein, when the first mode selecting portion selects the first mode, the feed control portion has the feeding device initiate the feeding of the following recording medium at the first feed timing, and, when the first mode selecting portion selects the second mode, the feed control portion has the feeding device initiate the feeding of the following recording medium at the second feed timing.

2. The image recording apparatus according to claim 1, wherein a second mode selecting portion is configured to select a first feed mode when the image data inputted to the drive-data supplying portion is of monochrome, and wherein the second mode selecting portion is configured to select a second feed mode when the image data inputted to the drive-data supplying portion is of color.

3. The image recording apparatus according to claim 1, wherein the first mode and the second mode differ from each other in a speed at which the feeding device feeds each of the recording media.

4. The image recording apparatus according to claim 1, wherein a second mode selecting portion is configured to select one of a first mode and a second mode depending on the kind of the recording media.

5. The image recording apparatus according to claim 1, wherein a second mode selecting portion is configured to select one of a first mode and a second mode depending on a resolution in the medium feed direction of the images to be recorded on the recording media.

6. The image recording apparatus according to claim 1, wherein when images to be recorded respectively on the preceding recording medium and the following recording medium differ from each other, the feed control portion has the feeding device initiate the feeding of the following recording medium at the second feed timing, and when the images to be recorded respectively on the preceding recording medium and the following recording medium are identical with each other and the drive-data supplying portion can supply the printheads with the drive data for the following recording medium before the preceding recording medium passes through the recording area, the feed control portion has the feeding device initiate the feeding of the following recording medium at the first feed timing.

7. The image recording apparatus according to claim 1, wherein every time one of the recording media as the following recording medium is about to be fed, it is determined whether a data amount of the image data of the image to be recorded on the following recording medium is larger than a threshold, and when the data amount is larger than the threshold, the feed control portion has the feeding device initiate the feeding of the following recording medium at the second feed timing, and when the data amount is not larger than the threshold and the drive-data supplying portion can supply the printheads with the drive data for the following recording medium before the preceding recording medium passes through the recording area, the feed control portion has the feeding device initiate the feeding of the following recording medium at the first feed timing.

8. The image recording apparatus according to claim 1, further comprising:

a reading device which reads an image formed on a document; and a read-image supplying portion which generates read-image data which is image data of the image read by the reading device, and supplies the read-image data to the drive-data supplying portion, and wherein when the read-image supplying portion supplies the read-image data to the drive-data supplying portion and the drive-data supplying portion can supply the printheads the drive data for the following recording medium before the preceding recording medium passes through the recording area, the feed control portion has the feeding device initiate the feeding of each of the recording media at the first feed timing.

9. The image recording apparatus according to claim 1, wherein each of the printheads include a plurality of recording elements apart from one another with respect to the medium feed direction, and the first feed timing is such that the distance between the trailing end of the preceding recording medium and the front end of the following recording medium becomes larger than a distance in the medium feed direction between two of the recording elements which are the most distant from each other in the medium feed direction in each of the printheads.

10. The image recording apparatus according to claim 1, wherein the printheads include a plurality of groups of printheads each of which corresponds to one of a plurality of colors, and the first feed timing is such that the distance between the trailing end of the preceding recording medium and the front end of the following recording medium becomes larger than a dimension of each of the groups in the medium feed direction.

11. The image recording apparatus according to claim 1, wherein each of the printheads has a recording surface on which are formed a plurality of recording elements from each of which a liquid is ejected in the form of droplet in order to form the image on the recording medium, and wherein when the feed control portion has the feeding device initiate the feeding of the following recording medium at the first feed timing, the drive data supplied from the drive-data supplying portion to at least one of the printheads, which is not to be opposed to either of the preceding and following recording media while the concurrent image recording on the trailing end portion of the preceding recording medium and the front end portion of the following recording medium is performed, is adjusted in order not to eject the liquid from the recording elements of the at least one printhead.

12. An image recording apparatus comprising:

a plurality of line-type printheads which are disposed parallel to one another and arranged in a medium feed direction, the printheads recording an image on each of a plurality of recording media which are sequentially fed one by one in the medium feed direction;

a feeding device which sequentially feeds the recording media to a recording area, two opposite ends of which in the medium feed direction respectively correspond to a most upstream one and a most downstream one of the printheads;

a drive-data supplying portion which generates a plurality of pieces of drive data for driving the printheads on the basis of image data of the image to be recorded on the recording medium, and supplies the pieces of drive data to the respectively corresponding printheads; and a feed control portion which has the feeding device initiate feeding of one of the recording media as a following recording medium which is fed next to another recording medium as a preceding recording medium, (i) at a first feed timing in order that a distance between a trailing end of the preceding recording medium and a front end of the following recording medium becomes smaller than a dimension of the recording area in the medium feed direction, when the drive-data supplying portion can supply the drive data to the printheads at a concurrent-recording enabling timing at which it is possible to concurrently record, at the recording area, an image on a trailing end portion of the preceding recording medium and an image on a front end portion of the following recording medium, and (ii) at a second feed timing in order that the distance between the trailing end of the preceding recording medium and the front end of the following recording medium becomes equal to or larger than the dimension of the recording area in the medium feed direction, when the drive-data supplying portion cannot supply the drive data to the printheads at the concurrent-recording enabling timing, wherein where $t1$ represents a time necessary for the preceding recording medium to pass through the recording area and $t2$ represents a time necessary for the drive-data supplying portion to supply the printheads with the drive data for the following recording medium, and where a speed at which the feeding device feeds each of the recording media changes from a value establishing a first condition: $t1 \geqq t2$ to a value establishing a second condition: $t1 < t2$, the feed control portion has the feeding device initiate the feeding of each of the recording medium at the first feed timing while the first condition is established, and at the second feed timing while the second condition is established.

* * * * *